US009310152B1

(12) United States Patent
Poling

(10) Patent No.: US 9,310,152 B1
(45) Date of Patent: Apr. 12, 2016

(54) MUZZLE BRAKE

(71) Applicant: Elite Iron LLC, Potomac, MT (US)

(72) Inventor: Dale Avery Poling, Potomac, MT (US)

(73) Assignee: Elite Iron LLC, Potomac, MT (US)

( * ) Notice: Subject to any disclaimer, the term of this patent is extended or adjusted under 35 U.S.C. 154(b) by 0 days.

(21) Appl. No.: 14/633,977

(22) Filed: Feb. 27, 2015

(51) Int. Cl.
*F41A 21/00* (2006.01)
*F41A 21/36* (2006.01)

(52) U.S. Cl.
CPC ..... *F41A 21/36* (2013.01)

(58) Field of Classification Search
CPC ..... F41A 21/26; F41A 21/30; F41A 21/32; F41A 21/34; F41A 21/36; F41A 21/38
See application file for complete search history.

(56) References Cited

U.S. PATENT DOCUMENTS 4,643,073 A * 2/1987 Johnson ..... F41A 21/36 89/14.3
4,879,942 A * 11/1989 Cave ..... F41A 21/36 89/14.3
5,092,223 A * 3/1992 Hudson ..... F41A 21/38 89/14.2
5,476,028 A * 12/1995 Seberger ..... F41A 21/36 89/14.3
7,861,636 B1 * 1/2011 Hoffman ..... F41A 21/34 89/14.2
8,042,448 B1 * 10/2011 Sylvester ..... F41A 21/34 42/1.06
8,087,337 B1 * 1/2012 Cary ..... F41A 21/30 89/14.3
8,578,832 B2 * 11/2013 Adolphsen ..... F41A 21/02 89/14.3
2003/0106416 A1 * 6/2003 Vais ..... F41A 21/36 89/14.3
2008/0083321 A1 * 4/2008 Dueck ..... F41A 21/36 89/14.3

OTHER PUBLICATIONS

Elite Iron Muzzle Brake. <http://web.archive.org/web/20131002213239/http://www.eliteiron.com/elite-iron-MuzzleBrakes.html>. Oct. 2, 2013.*

* cited by examiner

*Primary Examiner* — Gabriel Klein
(74) *Attorney, Agent, or Firm* — Wood Herron & Evans LLP

(57) ABSTRACT

Disclosed is a muzzle brake for a firearm having a barrel with a muzzle and a bore extending along a longitudinal axis. The muzzle brake includes a body with an axial passageway substantially axially aligned with the bore. A high pressure chamber in the body receives combustion gases from the muzzle and includes at least one outlet port for venting a first portion of the combustion gases in the high pressure chamber. A second chamber in the body, forward of the high pressure chamber, receives at least a second portion of the combustion gases from the high pressure chamber. The second chamber has two opposing side openings in the body and includes a rear wall and a rearwardly-facing front wall upon which the second portion of the combustion gases impinge. The front wall has two rearwardly curved surfaces transverse to the axial passageway that form an apex transverse to the longitudinal axis. The muzzle brake may also include a cupped concavity in at least one of the rearwardly curved surfaces of the forward wall.

11 Claims, 6 Drawing Sheets

MUZZLE BRAKE

TECHNICAL FIELD

This invention relates to a muzzle brake/compensator for firearms. More particularly, it relates to a muzzle brake/compensator that is particularly effective for maintaining aim of a rifle when the shooter is moving while firing.

BACKGROUND OF THE INVENTION

Muzzle brakes for firearms typically include a baffle wall against which the muzzle blast of burning gases will impact, while having an opening through which the projectile is allowed to pass. Baffle surfaces of this type are intended to reduce recoil by redirecting the force of the muzzle blast and imparting a portion of its energy forward, opposite the rearward recoil. Compensating muzzle brakes typically include ports or vents oriented to reduce muzzle rise and steady the barrel against any asymmetric lateral forces.

The need for an effective muzzle brake or compensator is particularly important when the shooter is moving while firing, whether this is in a competition context, such as during "3-gun" or "run-and-gun" events, or in combat.

SUMMARY OF THE INVENTION

The present invention provides a muzzle brake for a firearm having a barrel with a muzzle and a bore extending along a longitudinal axis. The muzzle brake includes a body adapted for placement at the muzzle with an axial passageway forward of the muzzle and substantially axially aligned with the bore. A high pressure chamber is in the body for receiving combustion gases from the muzzle resulting from firing of the firearm. The high pressure chamber includes at least one outlet port for venting a first portion of the combustion gases in the high pressure chamber directionally positioned to counter, at least in part, upward movement of the muzzle when the firearm is fired. The muzzle brake further includes at least a second chamber in the body forward of the high pressure chamber for receiving at least a second portion of the combustion gases from the high pressure chamber. The second chamber has two opposing side openings in the body for laterally venting at least a portion of the second portion of the combustion gases from the second chamber and includes a rear wall and a rearwardly-facing front wall upon which the second portion of the combustion gases from the high pressure chamber entering the second chamber impinge. The front and rear walls are substantially transverse to the longitudinal axis and the front wall has two surfaces rearwardly curved transverse to the axial passageway to form an apex transverse to the longitudinal axis.

The muzzle brake may also include one or more cupped concavities in at least one of the rearwardly curved surfaces of the forward wall laterally offset from the axial passageway. The rear wall of the second chamber may have three forwardly-curved surfaces transverse to the axial passageway, one substantially transversely aligned with the axial passageway, one generally above the axial passageway, and one generally below the axial passageway. The curved surfaces together form apices extending transverse to the longitudinal axis substantially adjacent upper and lower extents of the axial passageway.

According to another aspect of the invention, a forward face of the body can include a plurality of generally radially oriented flow passageways defined between non-radial vanes. The vanes may include a curved surface, causing the passageways to be substantially spiral. When the rifled bore imparts a spin on a projectile passing through it, the vanes may be angled to define passageways directed opposite to the direction of projectile spin to counteract rotational recoil forces.

Other aspects, features, and benefits of the present invention will be apparent to a person of skill in the firearms art upon consideration of the drawing figures, detailed description of an exemplary embodiment, and the claims, all of which comprise disclosure of the invention.

BRIEF DESCRIPTION OF THE DRAWING

Like reference numerals are used to indicate like parts throughout the various figures of the drawing, wherein.

DETAILED DESCRIPTION OF THE INVENTION

Figure 1:
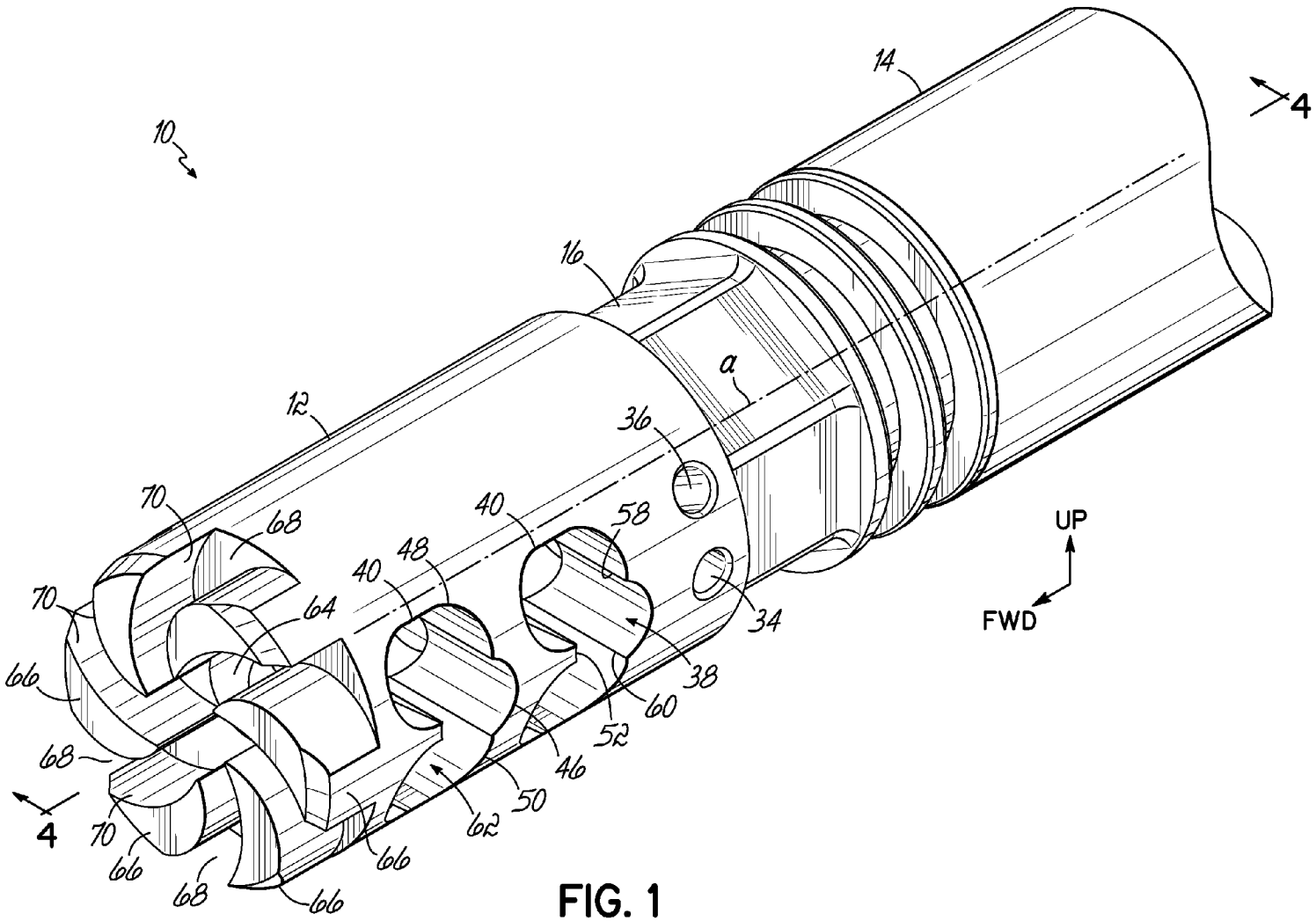
FIG. 1 is an isometric view from a forward angle of the muzzle brake according to one embodiment of the present invention shown on a portion of a firearm barrel.
Figure 2:
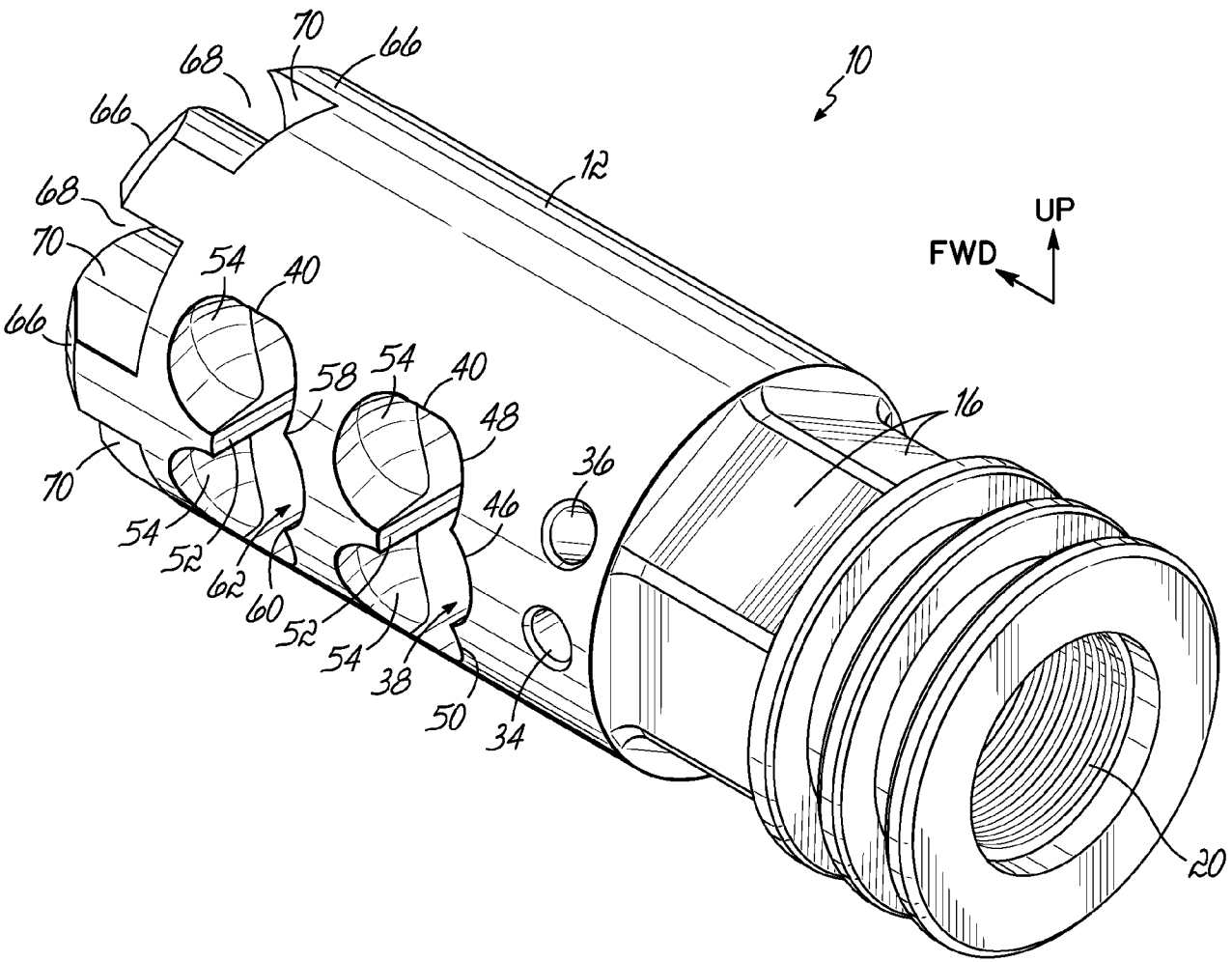
FIG. 2 is a rear angle isometric view of the muzzle brake.
Figure 3:
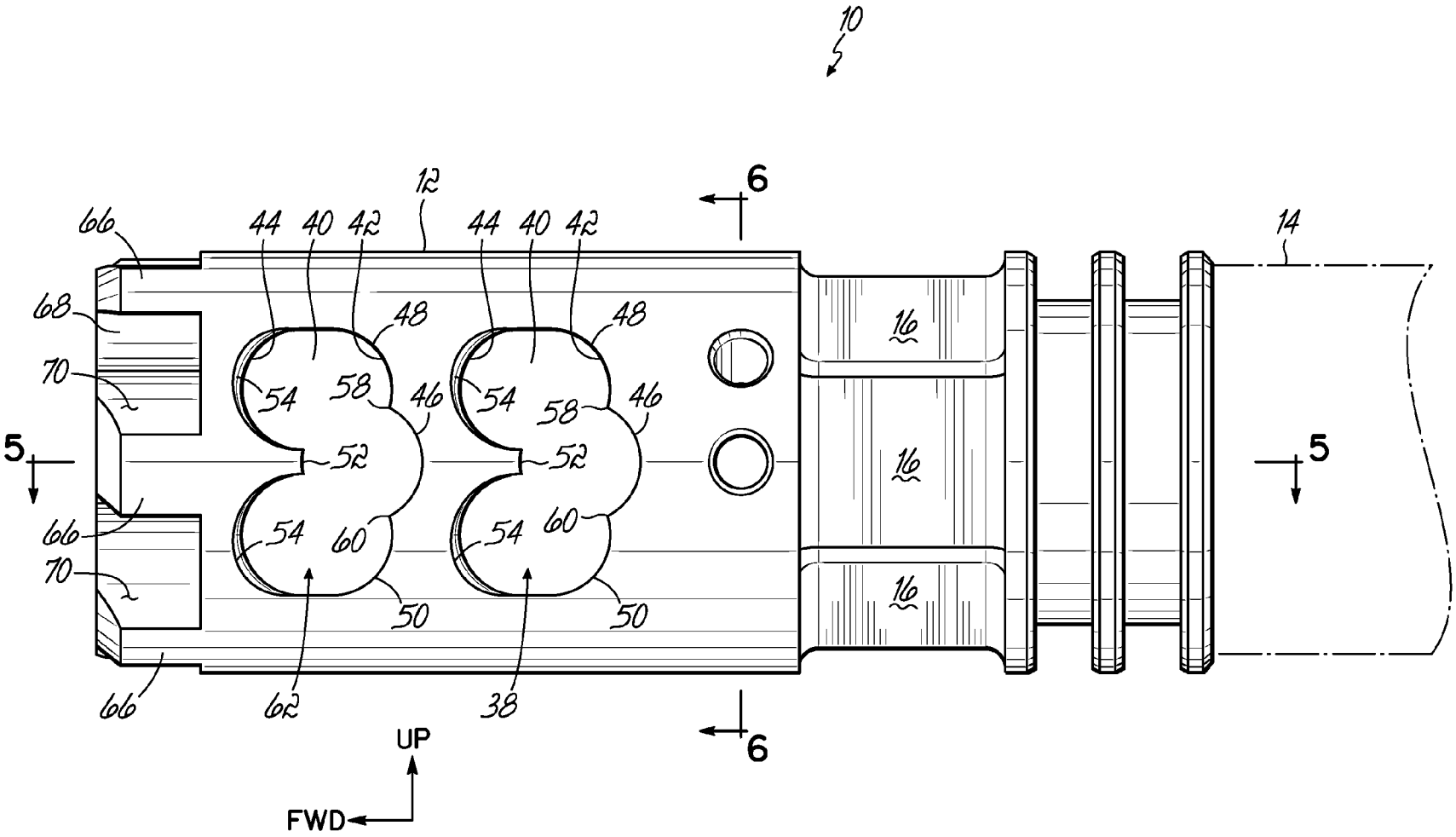
FIG. 3 is a side elevation view thereof.

Referring to the various figures of the drawing, and first to FIGS. 1-3, therein is shown at 10 a muzzle brake/compensator according to one embodiment of the present invention. The device 10 has a substantially cylindrical body 12 that may be attached to or an extension of a firearm barrel 14. In a model that is threaded onto the muzzle of the barrel 14, the body 12 may include wrench flats 16 for applying torque to the body 12 as it is threaded onto or removed from the barrel 14.

As used herein, "front" or "forward" correspond to the firing direction of the firearm represented by the firearm barrel 14; "rear" or "rearward" correspond generally to the direction opposite the front or forward direction and toward the shooter holding the firearm; "longitudinal" means the direction along or parallel to a longitudinal axis a of the bore 18 of the barrel 14. Directional orientation is indicated by labeled arrows in FIGS. 1-5.

Figure 4:
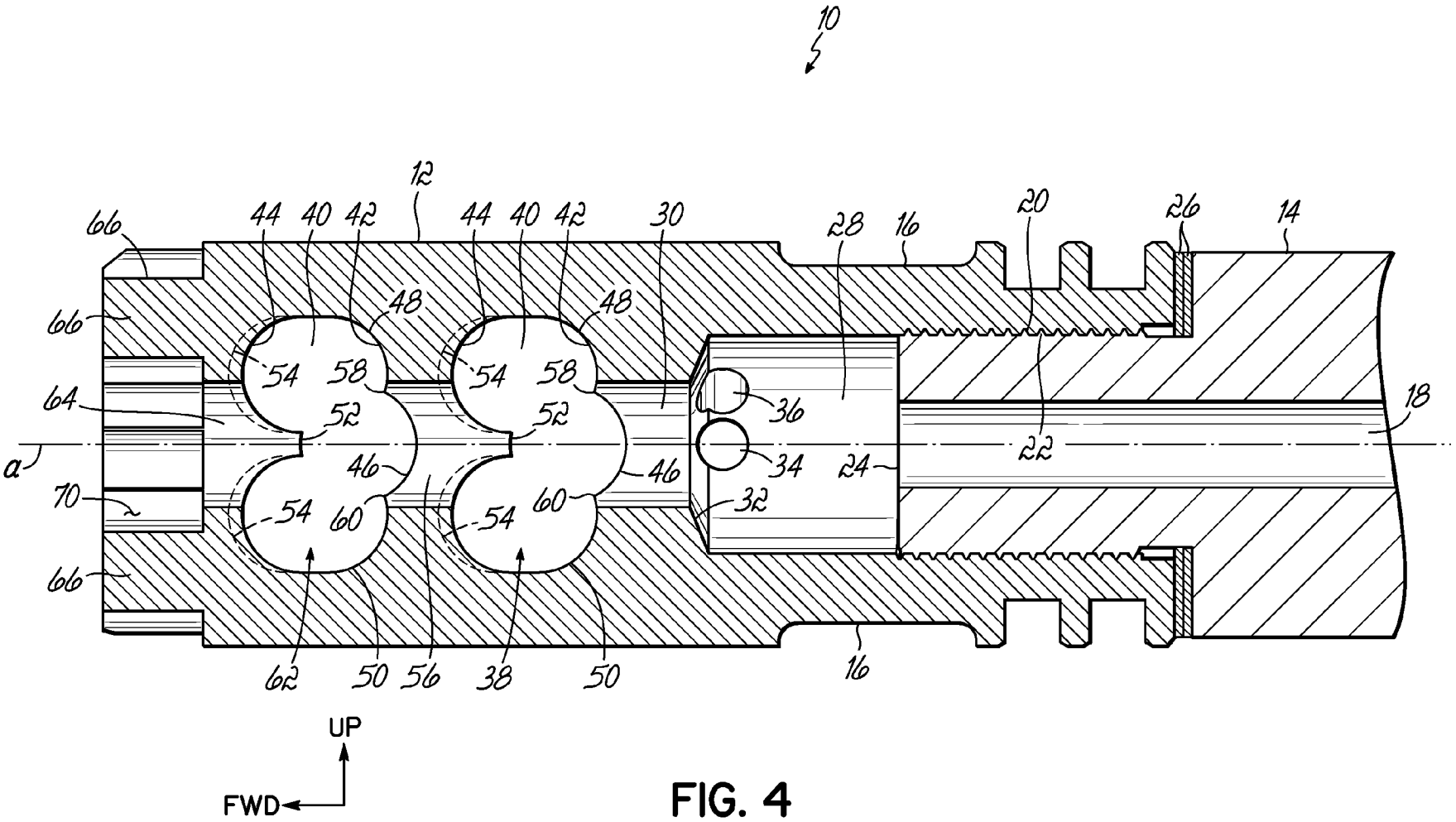
FIG. 4 is a side longitudinal sectional view taken substantially along line 4-4 of FIG. 1.
Figure 5:
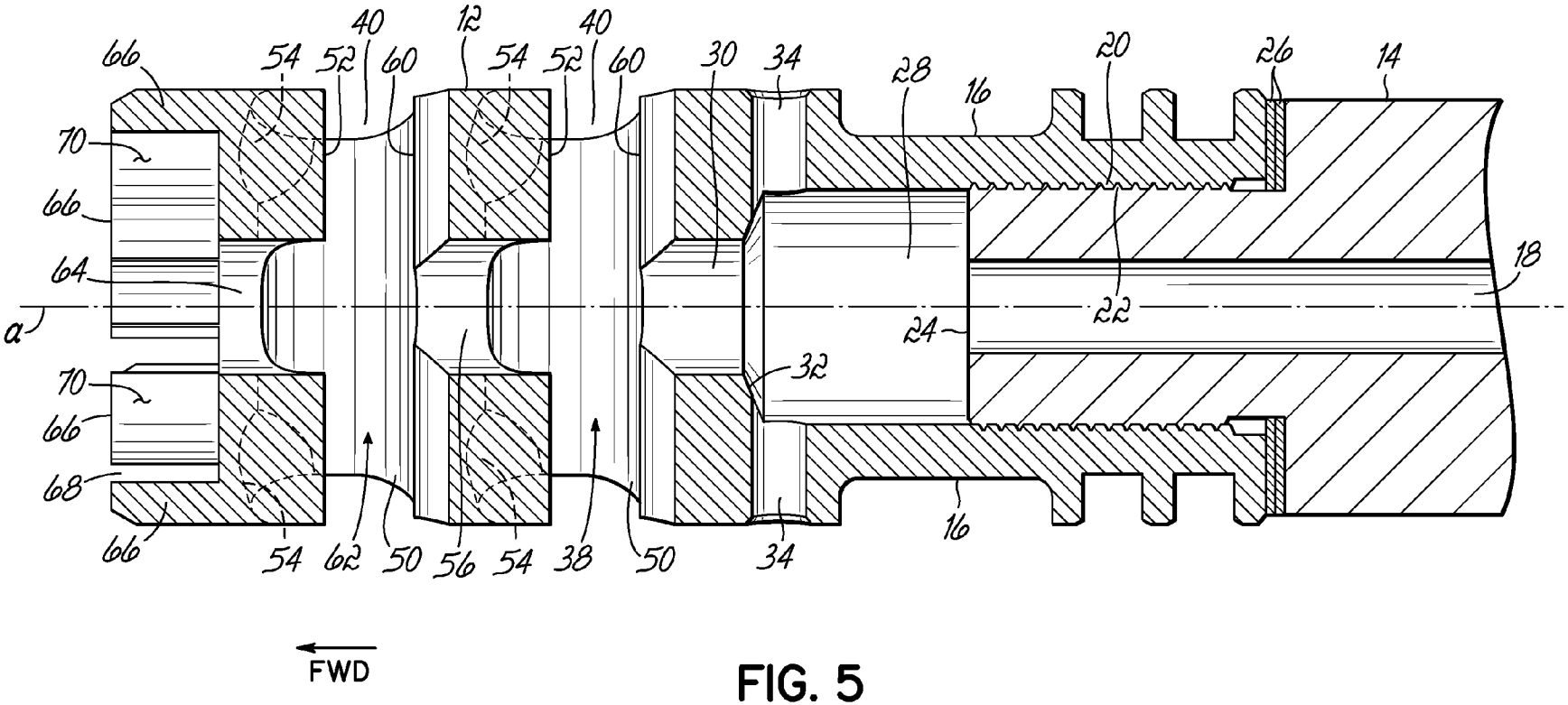
FIG. 5 is a top longitudinal sectional view taken substantially along line 5-5 of FIG. 3.

Referring now also to FIG. 4, the body 12 includes an axial passageway or series of passageways that are substantially aligned with the bore 18 of the barrel 14. In the illustrated embodiment, the brake 10 is attached to the barrel 14 by way of engaging internal threads 20 at the rearward end of the body 12 with external threads 22 provided adjacent the muzzle 24 of the barrel 14. As will be explained further below, vertical orientation of the muzzle brake 10 is important to some aspects of the illustrated embodiment. Therefore, rotational orientation of the muzzle brake 10 relative to the barrel 14 can be important and may be fixed, as well known in the art, by use of either a crush washer (not shown) or shims 26 (shown in FIGS. 4 and 5).

Referring now particularly to FIG. 4, therein can be seen a series of chambers spaced along an axial passageway inside the body 12 of the muzzle brake 10. Immediately forward of the muzzle 24 is a first or high pressure chamber 28. Typically, the high pressure chamber 28 may have a cross-sectional area that is greater than that of the bore 18, allowing propellant gases escaping from the bore 18 to expand as they exit the muzzle 24. Also in the illustrated embodiment, there is an outlet axial passageway 30 that is smaller in cross-sectional area than that of the high pressure chamber 28, but greater than that of the bore 18 so that a projectile may pass closely but freely therethrough. Additionally, this configuration may form a forward annular wall surface 32 against which propellant gases impact and transfer a forwardly-directed force to the body 12.

Figure 6:
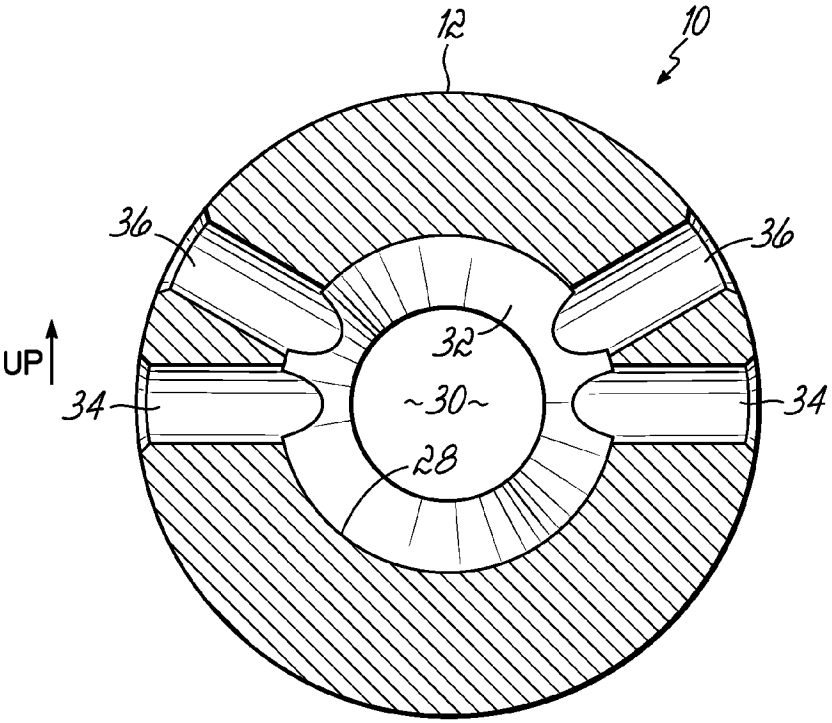
FIG. 6 is a cross-sectional view taken substantially along line 6-6 of FIG. 3.

The high pressure chamber 28 may include one or more radial exhaust ports 34, 36 at or near a forward position in the chamber 28 and adjacent the annular wall surface 32. As shown in FIG. 6, the exhaust ports 34, 36 may be at or above a horizontal orientation. Such positioning facilitates in counteracting lateral and/or upward movement of the muzzle end of the barrel 14, particularly when fired while the shooter is moving. High pressure gas ported laterally through the horizontal ports 34 help to stabilize against lateral reaction, while discharge flow of high pressure gases through the at least partially upwardly oriented ports 36 counteracts muzzle rise. Further attributes of exhausting high pressure gases through these radial exhaust ports 34, 36 from the high pressure chamber 28 will be described later.

At least a portion of the expanding propellant gases that flow into the high pressure chamber 28 from the bore 18 will pass forwardly, behind the projectile, through the first axial passageway 30 and into a second chamber 38 having large lateral openings 40. The second chamber 38 is defined between a rear wall 42 and a forward wall 44. The second chamber 38 may be formed, as shown, by milling or drilling into the body 12 a central lobe 46, substantially aligned with the axial passageway 30, and upper and lower lobes 48, 50, all extending transversely through the body 12. The lobes 46, 48, 50 may be shaped as partially overlapping cuts in circular or oblong shapes such that the chamber 38 intersects the axial passageway 30 and provides an enlarged expansion chamber area with substantially open sides through which at least a portion of the combustion gases that pass through the axial passageway 30 from the high pressure chamber 28 will exit.

The forward wall 44 of the chamber 38 presents a surface against which the combustion gases will impinge and transfer at least a portion of their forwardly-directed force. The forward wall 44 is formed with surfaces that are rearwardly curved transverse to the axial passageway 30 in forming apex transverse to the axis of the passageway 30 and barrel bore 18. The forward wall 44 may also curve rearwardly at the upper and lower boundaries of the upper and lower lobes 48, 50, presenting a substantially completely rounded impact surface. According to another aspect of the invention, the forward wall 44 of the chamber 38 may include one or more three-dimensional concavities 54 above and/or below the transverse apex 52 and laterally offset from the longitudinal axis a and a second outlet axial passageway 56. The surface of these concavities 54 may be formed, such as by milling with a ball mill tool inserted at an angle through the lateral openings 40, to resemble a portion of a sphere.

The rear wall 42 of the second chamber 46 also may be forwardly rounded or transversely concave in each of the three lobe regions 46, 48, 50, presenting a pair of apices 58, 60 on the rear wall 42 that extend transverse to the body 12 substantially at or adjacent to upper and lower extents of the first outlet axial passageway 30. This feature is best observed in FIGS. 3 and 4.

As propellant gases impact the front wall 44 of the chamber 38, the cupped shape of the concavities 54 can create a turbulent, converging flow pattern. As the flow of gases continues into the chamber, the swirling gases are forced out the lateral openings 40. The combination of the curved rear and front walls 42, 44 of the chamber 38 provided by the round or oblong transversely extending lobes 46, 48, 50, which present a central, rearwardly-facing transverse apex 52 and a pair of vertically spaced apart transversely extending apices 58, 60 on the rear wall 42, and the laterally spaced apart three-dimensional concavities 54 in the front wall 44 cause the propellant gases to be turbulently swirled inside and while exiting the lateral openings 40 of the second chamber 38. At least some of the swirling gases exiting the lateral openings 40 are directed at a rearward angle and will collide with the exhaust from the radial ports 34, 36 from the high pressure chamber 28, further dispersing flow of the exhaust of the propellant gases.

If desired, a third chamber 62 may be provided axially forward of the second chamber 38. At least a portion of the propellant gases entering the second chamber 38 will pass through the second outlet axial passageway 56 and into the third chamber 62. The architecture of the third chamber 62 may be similar to that of the second chamber 38 and will create similar turbulence and exhaust flow laterally outwardly there from. Additional forward chambers (not shown) like the second chamber 38 may be provided in axial alignment forward of the high pressure chamber 28, if desired.

Figure 7:
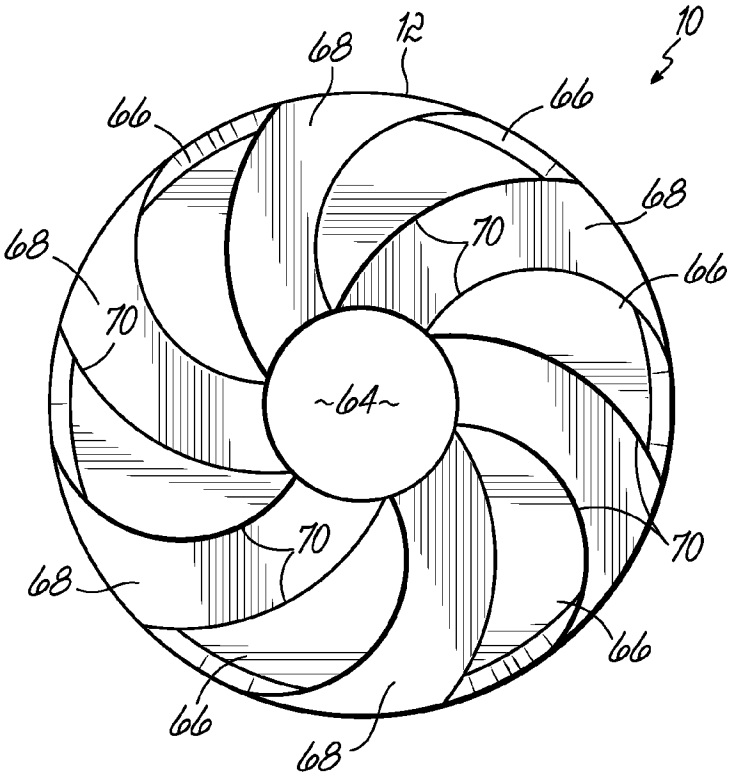
FIG. 7 is a front elevation view.

Referring now also to FIG. 7, the forwardmost chamber (in this case, the third chamber 62) includes a forward outlet axial passageway 64 through which the projectile and at least some portion of propellant gases will pass. Whatever portion of propellant gases that exits the final axial passageway 64 will further expand radially and interact with a plurality of non-radial vanes 66 and corresponding passageways 68 therebetween. The vanes 66 may be oriented at a tangent relative to the circumference of the forward outlet passageway 64 or may be in a spiral configuration, as shown in the illustrated embodiment. Accordingly, the passageways 68 are generally radially outwardly oriented, although defined between vanes 68 that are non-radial. In the illustrated example, each vane 66 presents a concave curved surface 70 against which the expanding propellant gases impart a force that is transferred to the body 12 (and, therefore, barrel 14) in a rotational direction opposite that of the force imparted by the projectile on rifling (not shown) in the bore 18. As the rifling imparts spin to a projectile, the projectile transfers an equal and opposite force to the barrel via the rifling. In the case of a right-hand (clockwise, as viewed from the rear) twist, a left-hand (counterclockwise) rotational force is transferred to the barrel 14. The spiral vanes 66 and passageways 68 illustrated in FIG. 7 are configured to counteract this left-hand rotation of the barrel 14 when the projectile is spun in a right-hand direction. A reverse orientation would be used with left-handed rifling.

It will be understood by a person of skill in the firearms field that the device may be scaled up or down, as necessary, for use with firearms of larger or smaller caliber. While the present invention has been illustrated by the description of an exemplary embodiment thereof, and while the embodiment has been described in considerable detail, it is not intended to restrict or in any way limit the scope of the appended claims to such detail. The various features discussed herein may be used alone or in other combinations. Additional advantages and modifications will readily appear to those skilled in the art. The invention in its broader aspects is therefore not limited to the specific details, representative apparatus, methods and illustrative examples shown and described. Accordingly, departures may be made from such details without departing from the scope or spirit of the general inventive concept.

What is claimed is:

1. A muzzle brake for a firearm having a barrel with a muzzle and a bore extending along a longitudinal axis, the muzzle brake comprising:

a body adapted for placement at the muzzle, the body including an axial passageway forward of the muzzle and substantially axially aligned with the bore;

a high pressure chamber in the body extending along the axial passageway for receiving combustion gases from the muzzle resulting from firing of the firearm, the high pressure chamber including at least one outlet port for venting a first portion of the combustion gases in the high pressure chamber directly to atmosphere and directionally positioned to counter, at least in part, upward movement of the muzzle when the firearm is fired; and a second chamber in the body extending along the axial passageway forwardly of the high pressure chamber for receiving at least a second portion of the combustion gases from the high pressure chamber, the second chamber having two opposing side openings in the body for laterally venting at least a portion of the second portion of the combustion gases from the second chamber directly to atmosphere; and wherein the second chamber includes a rearwardly-facing front wall upon which the second portion of the combustion gases from the high pressure chamber entering the second chamber impinge and a rear wall, the front and rear walls being substantially transverse to the longitudinal axis, the front wall having two surfaces rearwardly curved transverse to the axial passageway and forming an apex extending transverse to the longitudinal axis and toward the opposing side openings, and at least one of the rearwardly curved surfaces of the forward wall including a cupped concavity laterally offset from the axial passageway.

2. The muzzle brake of claim 1, comprising a plurality of the cupped concavities.

3. The muzzle brake of claim 1, wherein the rear wall of the second chamber has three forwardly-curved surfaces transverse to the axial passageway, one substantially transversely aligned with the axial passageway, one generally above the axial passageway, and one generally below the axial passageway, the curved surfaces together forming apices extending transverse to the longitudinal axis substantially adjacent upper and lower extents of the axial passageway.

4. The muzzle brake of claim 1, further comprising:

a third chamber in the body extending along the axial passageway forwardly of the second chamber for receiving at least a third portion of the combustion gases from the second chamber, the third chamber having two opposing side openings in the body for laterally venting at least a portion of the third portion of the combustion gases from the third chamber; and wherein the third chamber includes a rearwardly-facing front wall upon which the third portion of the combustion gases from the high pressure chamber entering the third chamber impinge and a rear wall, the front and rear walls being substantially transverse to the longitudinal axis, and the front wall having two surfaces rearwardly curved transverse to the axial passageway and forming a apex transverse to the longitudinal axis.

5. The muzzle brake of claim 1, wherein the high pressure chamber has cross-section greater than that of the axial passageway, forming an annular rearwardly-facing wall against which combustion gasses from the muzzle impinge.

6. The muzzle brake of claim 1, wherein the high pressure chamber has plurality of outlet ports.

7. The muzzle brake of claim 6, comprising substantially laterally opposed outlet ports and at least one outlet port at least partially upwardly directed.

8. The muzzle brake of claim 1, further comprising a forward face having a plurality of generally radially oriented flow passageways defined between non-radial vanes.

9. The muzzle brake of claim 8, wherein the vanes include a curved surface causing the passageways to be substantially spiral.

10. The muzzle brake of claim 8, wherein the bore includes rifling that imparts a spin on a projectile passing through the bore, and the vanes are angled to define passageways directed opposite to the direction of projectile spin.

11. The muzzle brake of claim 8, wherein the flow passageways are forwardly open.

* * * * *